US009378695B2

(12) United States Patent
Kim et al.

(10) Patent No.: US 9,378,695 B2
(45) Date of Patent: Jun. 28, 2016

(54) LIQUID CRYSTAL DISPLAY AND DRIVING METHOD THEREOF

(71) Applicant: SAMSUNG DISPLAY CO., LTD., Yongin, Gyeonggi-Do (KR)

(72) Inventors: Ah-Reum Kim, Hwaseong-si (KR); Ja Kyoung Jin, Daegu (KR); Joon-Chul Goh, Hwaseong-si (KR); Gi Geun Kim, Seoul (KR); Yun Ki Baek, Suwon-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 7 days.

(21) Appl. No.: 14/446,656

(22) Filed: Jul. 30, 2014

(65) Prior Publication Data

US 2015/0035819 A1 Feb. 5, 2015

(30) Foreign Application Priority Data

Jul. 30, 2013 (KR) ..... 10-2013-0090420

(51) Int. Cl.
*G09G 3/36* (2006.01)

(52) U.S. Cl.
CPC ..... *G09G 3/3618* (2013.01); *G09G 2354/00* (2013.01)

(58) Field of Classification Search
CPC ..... G09G 2354/00; G09G 3/3618
USPC ..... 345/204, 209, 691, 211–214
See application file for complete search history.

(56) References Cited

U.S. PATENT DOCUMENTS

| | | | | |
|---|---|---|---|---|
| 2005/0243024 | A1 | 11/2005 | Sempel et al. | |
| 2009/0096769 | A1 | 4/2009 | Kim et al. | |
| 2011/0181802 | A1* | 7/2011 | Wakimoto | G09G 3/3648 349/19 |
| 2012/0044225 | A1* | 2/2012 | Kim | G09G 3/3614 345/209 |
| 2012/0154416 | A1 | 6/2012 | Nakanishi et al. | |
| 2012/0242570 | A1 | 9/2012 | Kobayashi | |
| 2013/0038639 | A1 | 2/2013 | Han et al. | |
| 2013/0063340 | A1 | 3/2013 | Mondragon et al. | |
| 2014/0015870 | A1* | 1/2014 | Takahashi | G09G 3/3611 345/691 |
| 2015/0029096 | A1* | 1/2015 | Ishihara | H04N 5/63 345/156 |

FOREIGN PATENT DOCUMENTS

| | | | |
|---|---|---|---|
| JP | 2009-081529 | A | 4/2009 |
| KR | 10-2004-0078298 | A | 9/2004 |
| KR | 10-0463345 | B1 | 12/2004 |
| KR | 10-0993976 | B1 | 11/2010 |
| KR | 10-2013-0015780 | A | 2/2013 |

* cited by examiner

*Primary Examiner* — Quan-Zhen Wang
*Assistant Examiner* — Tony Davis
(74) *Attorney, Agent, or Firm* — Lee & Morse, P.C.

(57) ABSTRACT

A liquid crystal display includes a signal controller to generate a plurality of start pulse signals based on a plurality of eye blinking signals during a predetermined mode of operation. The start pulse signals are generated in a manner different from a vertical synchronization signal. The start signals may be generated to have an irregular spacing which corresponds to the blinking signals, which may be different from a constant spacing used during display of moving images. The predetermined mode may be a still image mode.

19 Claims, 9 Drawing Sheets

FIG.9

| | 1st frame | 2nd frame | 3rd frame | ··· | n-th frame |
|---|---|---|---|---|---|
| G0 | 0 | 0 | 0 | ··· | 0 |
| G1 | 0 | 0 | 1 | ··· | 1 |
| ··· | ··· | ··· | ··· | ··· | ··· |
| G254 | 249 | 251 | 252 | ··· | 254 |
| G255 | 250 | 252 | 253 | ··· | 255 |

LIQUID CRYSTAL DISPLAY AND DRIVING METHOD THEREOF

CROSS-REFERENCE TO RELATED APPLICATION

Korean Patent Application No. 10-2013-0090420, filed on Jul. 30, 2013, in the Korean Intellectual Property Office, and entitled, "Liquid Crystal Display and Driving Method Thereof," is incorporated by reference herein in its entirety.

BACKGROUND

1. Field

One or more embodiments described herein relate to a display device.

2. Description of the Related Art

A liquid crystal display is one of the many types of flat panel displays currently in use. This type of display includes a liquid crystal layer between a pixel electrode and a common electrode, and data and gate drivers are controlled to generate an image from a plurality of pixels. In operation, the pixel electrode receives a data voltage through a switching element and a counter electrode receives a common voltage. These voltages cause an electric field to be generated in the liquid crystal layer to control transmittance of light, thereby displaying an image.

The liquid crystal display may also receive an image signal from an external graphics controller. The image signal contains luminance information on each pixel, and the data voltage to be applied to each pixel corresponds to the desired luminance information. The data voltage appears as a pixel voltage depending on a difference from the common voltage applied to the common electrode. Each pixels displays luminance represented by a gray scale value of the image signal depending on the pixel voltage.

One effect which degrades the quality of images on a liquid crystal display is known as the degradation phenomenon. This phenomenon occurs when the electric field to the liquid crystal layer is applied in one direction for a long period of time. In an attempt to prevent the degradation phenomenon, the polarity of the data voltage may be inverted respect to a reference voltage on a frame, row, column, or pixel basis. Further, in an attempt to prevent unwanted textures (e.g., a vertical line), the polarity of the pixel voltages of adjacent pixels may set to be different.

Another undesirable effect may occur as a result of the liquid crystal layer. For example, the liquid crystal display may have different response characteristics during the period between when the polarity of the pixel voltage changes from a negative to a positive voltage and when the polarity of the pixel voltage changes from a positive to a negative voltage. For example, the rising speed of the pixel voltage may be slower than a falling speed. The difference in these speeds may cause a change in luminance.

The luminance change may cause problems when the liquid crystal display is driven. For example, differences in luminance may be visually recognized when the liquid crystal display is driven at a relatively low frequency. Referring to a temporal contrast sensitivity function (TCSF), in particular, even though the actual change in luminance may be small when the liquid crystal display is driven at a low frequency, the change in luminance is recognized to be considerable. As a result, flicker may be visually recognized which leads to a degradation in display quality.

SUMMARY

In accordance with one embodiment, a liquid crystal display includes a display panel having a display panel including a plurality of gate lines, a plurality of data lines, and a plurality of pixels; a gate driver to apply a gate-on voltage to each of the gate lines; a data driver to apply a positive data voltage and a negative data voltage to the data lines; a signal controller to control the gate driver and data driver and to receive image data; and a sensor to generate a blinking signal for input into the signal controller. The signal controller is configured to drive the data driver and gate driver at one of a moving image frequency or still image frequency, and the signal controller is configured to control refresh of the pixels based on to the blinking signal from the sensor when a still image is displayed.

The signal controller may be configured to control refresh of the pixels by generating a start pulse vertical signal STV synchronized with the blinking signal. The signal controller may be configured to synchronize a data enable signal with the start pulse vertical signal STV, which is synchronized with the blinking signal. The data driver may be configured to supply each of the pixels with a data voltage, a polarity of the data voltage inverted depending on the start pulse vertical signal STV.

The signal controller may generate the start pulse vertical signal STV in synchronism with the blinking signal based on a blinking enable signal BE. When a period of the blinking signal is longer than a period determined based on the still image driving frequency of the display panel, the signal controller may generate the start pulse vertical signal STV irrespective of receiving the blinking signal. The signal controller may generate the start pulse vertical signal STV to be synchronized with the still image driving frequency.

When the period of the blinking signal is longer than a period determined based on the still image driving frequency of the display panel, the signal controller may be configured to control driving of the display panel using a compensation lookup table, and the compensation lookup table includes values to compensate for a declined pixel voltage at a time of receiving the blinking signal. The signal controller may be configured to generate the start pulse vertical signal STV at a substantially constant rate at a time of receiving the blinking signal. The sensor may be configured to sense blinking based on motion of an eyelid of a user proximate the display panel.

In accordance with another embodiment, a method for driving a liquid crystal display includes receiving image data; identifying whether the image data is a moving image or a still image; controlling a gate driver and a data driver to display a moving image at a moving image frequency when the moving image is identified and to display a still image at a still image frequency when the still image is identified; sensing blinking to generate a blinking signal; and controlling refresh of one or more pixels in response to the blinking signal when the still image is displayed.

Controlling refresh of the one or more of pixels may include generating a start pulse vertical signal STV synchronized with the blinking signal. The method may include synchronizing a data enable signal with the start pulse vertical signal STV, which is synchronized with the blinking signal. The method may include inverting a polarity of a data voltage to each of the one or more pixels depending on the start pulse vertical signal STV.

Generating the start pulse vertical signal STV synchronized with the blinking signal may be controlled based on a blinking enable signal BE. Generating the start pulse vertical signal STV may be performed when a period of the blinking signal is longer than a period based on the still image frequency of the display panel and regardless of whether the blinking signal is received. The start pulse vertical signal STV may be synchronized with the still image driving frequency.

The method may include controlling the data driver based on a compensation lookup table when a period of the blinking signal is longer than a period based on the still image driving frequency. The compensation lookup table may include declined pixel voltages at the time of receiving the blinking signal. The start pulse vertical signal STV may be generated at a substantially constant interval at a time of receiving the blinking signal. The blinking signal may be generated only when the still image is displayed.

In accordance with another embodiment, an apparatus for controlling a liquid crystal display includes an input coupled to receive a plurality of eye blinking signals; and a signal controller to generate a plurality of start pulse signals based on the blinking signals during a predetermined mode of operation, the start pulse signals generated in a manner different from a vertical synchronization signal. The start pulse signals are generated to have an irregular spacing which corresponds to the blinking signals. The predetermined mode of operation may be a still image mode.

BRIEF DESCRIPTION OF THE DRAWINGS

Features will become apparent to those of ordinary skill in the art by describing in detail exemplary embodiments with reference to the attached drawings in which:

FIG. 9 illustrates an example of a lookup table for data compensation control.

DETAILED DESCRIPTION

Figure 1:
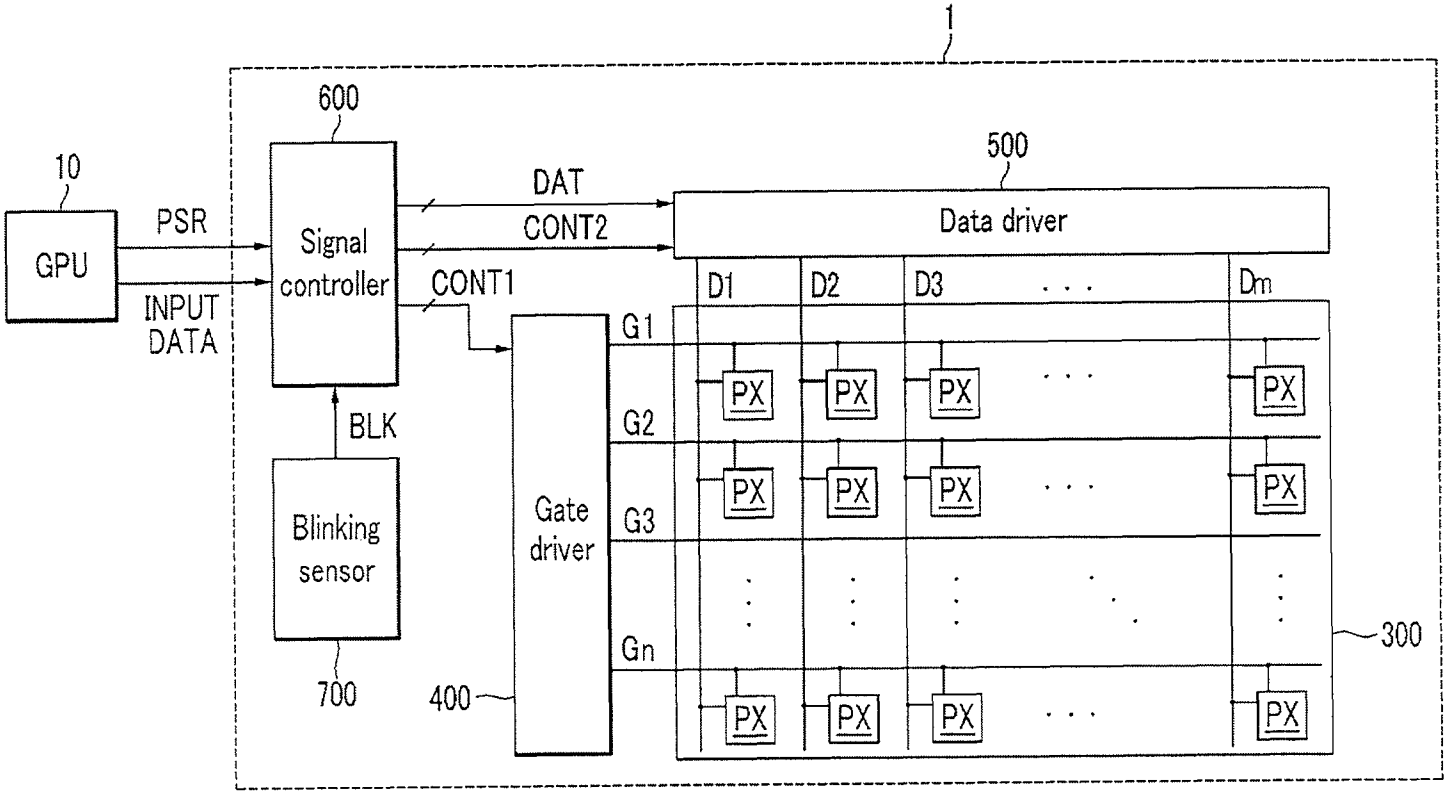
FIG. 1 illustrates an embodiment of a liquid crystal display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a liquid crystal display 1 which includes a liquid crystal panel 300 for displaying an image, a gate driver 400, a data driver 500, a signal controller 600, and a blinking sensor 700. In an alternative embodiment, the blinking sensor 700 may be positioned outside the liquid crystal display 1.

A graphic processing unit (GPU) 10 may be positioned outside the liquid crystal display 1. The graphic processing unit 10 may provide input data including data for displaying an image and a panel self-refresh (PSR) signal. The PSR signal may be a signal to identify whether a corresponding image is a still image or a moving image. The liquid crystal panel 300 may display an image based on the input data and the PSR signal. When the input data corresponds to a still image as identified by the PSR signal, an image of a previous frame may be displayed repeatedly.

Figure 2:
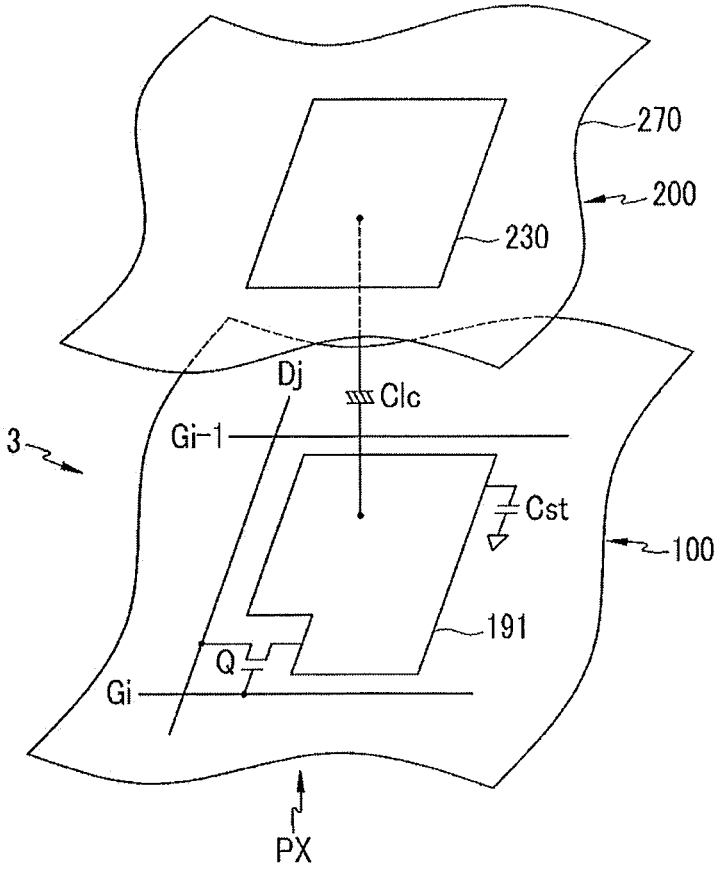
FIG. 2 illustrates an embodiment of a pixel in the liquid crystal display.

FIG. 2 illustrates an equivalent circuit diagram of an embodiment of a pixel and attendant features of the liquid crystal display 1. Referring to FIGS. 1 and 2, liquid crystal panel 300 includes lower and upper panels 100 and 200 which face each other and a liquid crystal layer 3 interposed therebetween. The liquid crystal panel 300 includes a plurality of gate lines G1 to Gn and a plurality of data lines D1 to Dm. The plurality of gate lines G1 to Gn extends in substantially a horizontal direction and the plurality of data lines D1 to Dm extends in substantially a vertical direction by intersecting the plurality of gate lines G1 to Gn, being insulated therefrom.

One of the gate lines G1 to Gn and one of the data lines D1 to Dm are connected to respective ones of the pixels PX. The pixels PX are arranged in a matrix form, and each pixel PX may include a thin film transistor Q, a liquid crystal capacitor Clc, and a sustain capacitor Cst. For each pixel, a control terminal of the thin film transistor Q may be connected to a corresponding one of the gate lines G1 to Gn and an input terminal of the thin film transistor Q may be connected to a corresponding one of the data lines D1 to Dm. An output terminal of the thin film transistor Q may be connected to a pixel electrode 191. The pixel electrode 191 may form one terminal of the liquid crystal capacitor Clc, and one terminal of the sustain capacitor Cst. The other terminal of the liquid crystal capacitor Clc is connected to a common electrode 270, and the other terminal of the sustain capacitor Cst may be applied with a sustain voltage.

According to one embodiment, the pixel electrode 191 and common electrode 270 (which may be considered to be field-generating electrodes) may be positioned on the lower panel 100. Also, in an alternative embodiment, the pixels PX of one row may be alternately connected to different adjacent gate lines on an alternating basis. That is, each gate line may be alternately connected to pixels in different rows, e.g., to upper and lower pixels. Thus, in this alternative embodiment, odd numbered pixels and even numbered pixels which belong to a same row may be connected to different gate lines. Each of the data lines D1 to Dm is connected to the pixels along a same column.

The signal controller 600 processes the input data, PSR signal, and one or more additional control signals (e.g., a vertical synchronization signal Vsync, a horizontal synchronization signal Hsync, a main clock signal MCLK) for operating the liquid crystal panel 300. The signal controller 600 generates and outputs image data DAT, a gate control signal CONT1, a data control signal CONT2, and a clock signal.

The gate control signal CONT1 includes a start pulse vertical signal STV for controlling a scanning start and a clock pulse vertical signal CPV which corresponds to generation of a gate-on voltage Von. An output period of the start pulse vertical signal STV coincides with one frame (or refresh rate).

The gate control signal CONT1 may further include an output enable signal OE, which limits a duration of the gate-on voltage Von.

The data control signal CONT2 includes a start pulse horizontal signal STH, a load signal TP, and a data enable signal DE. The start pulse horizontal signal STH controls a transmission start of the image data DAT for a pixel of one row. The load signal TP controls applying data voltages to corresponding ones of the data lines D1 to Dm. The data control signal CONT2 may further include an inversion signal RVS that inverts a polarity of the data voltage relative to a common voltage Vcom.

The signal controller 600 uses the gate control signal CONT1 and data control signal CONT2 to enable the gate driver 400 and the data driver 500 to display a still image and moving images on the liquid crystal panel 300. The still image may be displayed at a still image frequency and the moving images at a moving image frequency. When a plurality of consecutive frames corresponds to same image data, the still image is displayed. When a plurality of consecutive frames corresponds to different image data, moving images are displayed. The signal controller 600 may identify whether the image data is a moving image or the still image based on the PSR signal.

The signal controller 600 may control display of a still image at a still image frequency which is lower than a moving image frequency at which moving images are displayed. According to one example, the still image frequency may be equal to or less than about ⅔ of the moving image frequency, e.g., a value of about 10 Hz or less or a value of about 1 Hz or less.

The gate lines G1 to Gn are connected to the gate driver 400. The gate-on voltage Von may be sequentially applied to the gate lines based on the gate control signal CONT1 from the signal controller 600. The gate-off voltage Voff may be applied to a section in which the gate-on voltage Von is not applied.

The data lines D1 to Dm are connected to the data driver 500. The data driver 500 receives the data control signal CONT2 and the image data DAT from the signal controller 600. The data driver 500 uses the gray scale voltage generated from a gray scale voltage generator to convert the image data DAT into data voltages for the data lines D1 to Dm. The data voltages may include data voltages having a positive polarity and data voltages having a negative polarity. The positive and negative polarity data voltages may be alternately applied based on a frame and a row and/or a column, and thus driven according to an inversion method. The inversion driving method may be applied to both cases of displaying moving images and a still image.

The blinking sensor 700 monitors a human eye and senses when blinking occurs. The blinking sensor 700 may generate and transmit a blinking signal BLK to the signal controller 600. Monitoring the human eye may be performed by a monitoring device, e.g., a camera. The monitoring device may be positioned inside or outside sensor 700. In FIG. 1, the blinking sensor 700 is illustratively shown to be positioned inside the liquid crystal display 1.

The signal controller 600 generates and outputs the start pulse vertical signal STV to be synchronized with the vertical synchronization signal Vsync. The signal controller 600 may also generate and output the start pulse vertical signal STV to be synchronized with the blinking signal BLK, at a time of receiving the blinking signal BLK. Therefore, the data voltage may be applied to each pixel during blinking, such that each pixel is recharged (refreshed).

According to one embodiment, the signal controller 600 generates and outputs the start pulse vertical signal STV in response to the blinking signal BLK in the case of a still image, e.g., in the case of low frequency driving. When the still image is displayed, each pixel may also be refreshed by the control of the signal controller 600, even in the section in which the blinking signal BLK is not present.

Figure 3:
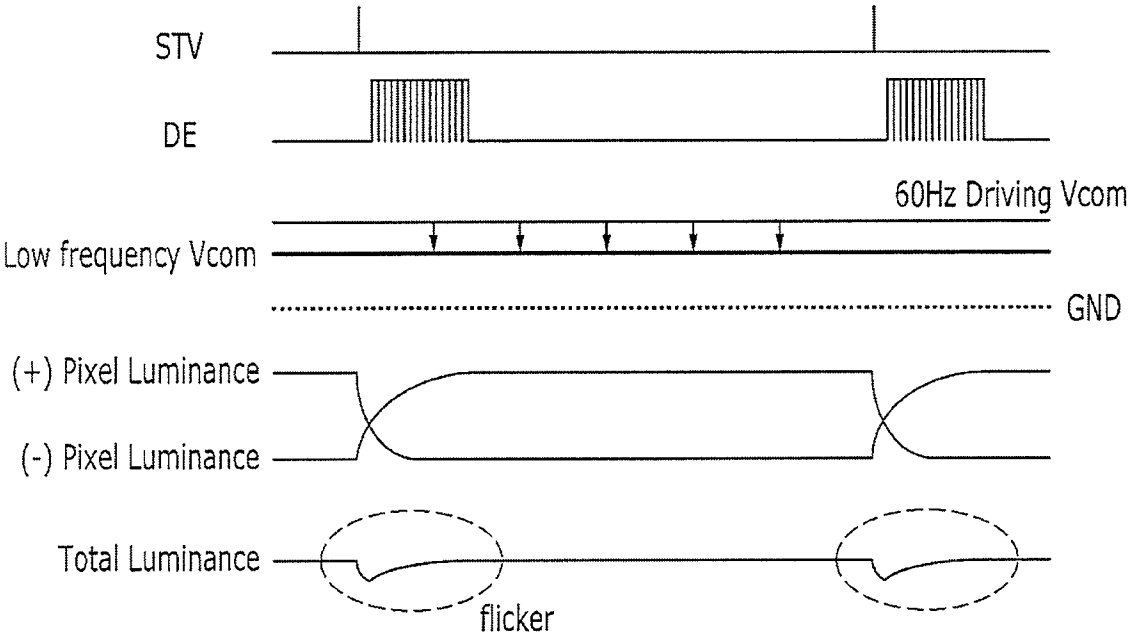
FIG. 3 illustrates an example of how voltage charged in a pixel may change and the entire luminance may change as a result of the voltage change.

FIG. 3 illustrates one way in which a voltage charged in a pixel may change and the entire luminance may change as a result of this voltage change. As shown in FIG. 3, there is a difference between the speed of charging a positively charged pixel with a negative voltage in response to the data enable signal DE based on the start pulse vertical signal STV, and the speed of charging a negatively charged pixel with a positive voltage in response to the data enable signal DE based on the start pulse vertical signal STV. That is, the rising response speed (at which the polarity of the pixel voltage is changed from a negative voltage to a positive voltage) may be slower than a falling response speed (at which the polarity of the pixel voltage is changed from a positive voltage to a negative voltage).

As further illustrated in the lower portion of FIG. 3, in connection with the entire luminance, the difference in response speed reduces luminance in the rising and falling sections relative to the luminance level in other sections. The change in luminance is visually recognized to be considerable, particularly when the still image frequency is a low frequency (e.g., about 10 Hz or less as previously indicated). This change in luminance may be visually recognized as a flicker, and this effect may increase as the frequency is reduced.

Figure 4:
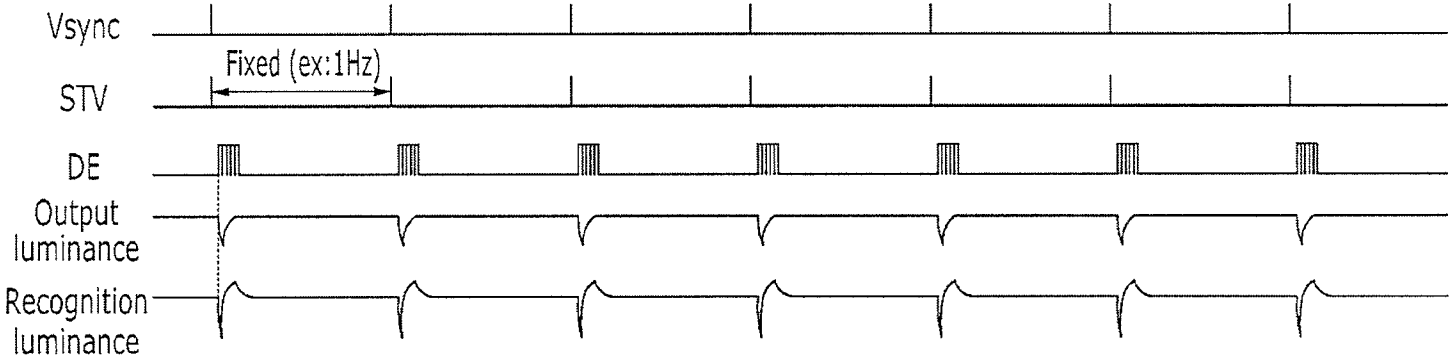
FIG. 4 illustrates a relationship between luminance and one or more control signals during low frequency driving.
Figure 5:
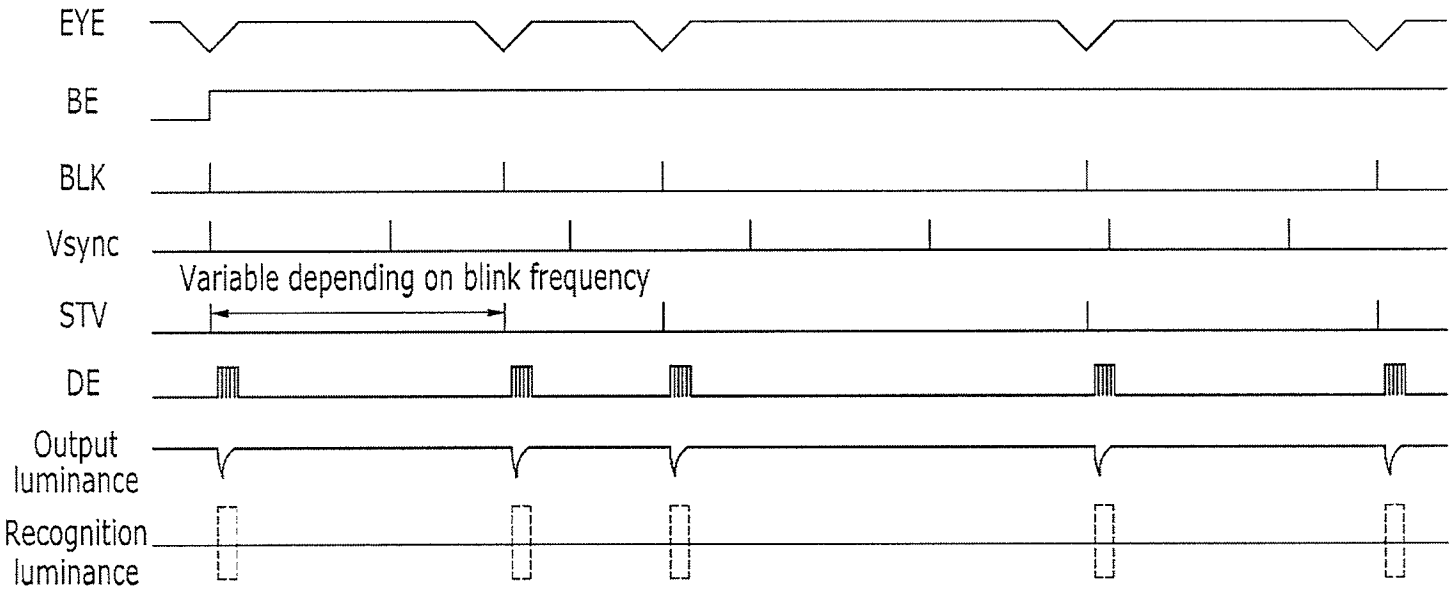
FIG. 5 illustrates a relationship between luminance and one or more control signals during low frequency driving according to one embodiment.

FIG. 4 illustrates a relationship that may exist between one or more signals and luminance during low frequency driving in a manner different from the embodiments described herein, and FIG. 5 illustrates a relationship between a signal and luminance during low frequency driving according to one embodiment.

Referring to these figures in view of FIG. 1, when the signal controller 600 determines that a still image is to be displayed based on the PSR signal, the start pulse vertical signal STV and the data enable signal DE have a changed period that must fit with the still image frequency, e.g., at 1 Hz. The liquid crystal panel 300 continuously displays the same screen and is refreshed at a constant period, for example, 1 Hz. As the driving frequency is reduced, power consumption of the liquid crystal display 1 is reduced. Therefore, when the still image is displayed at the still image frequency, power consumption may be reduced.

However, as described above, when data voltages having different polarities are applied to a pixel depending on the start pulse vertical signal STV, output luminance instantly fluctuates due to asymmetric response speed that depends on polarity. The fluctuation portion of the output luminance may appear, for example, at every 1 second, when the liquid crystal display is driven at the still image frequency (e.g., 1 Hz), and thus may be visually recognized. In addition, considering the recognition characteristics of the human eye, the fluctuation portion may be visually recognized in a pronounced way, and therefore may be more easily recognized than fluctuation in the output luminance. This is particularly evident from FIG. 4 which shows the fluctuation portions of the output luminance and recognition luminance.

FIG. 5 illustrates low frequency driving of a still image in accordance with one embodiment. In FIG. 5, start pulse vertical signal STV and data enable signal DE are synchronized with the blinking signal BLK, not vertical synchronization signal Vsync.

Also, FIG. 5 includes signals represented by EYE, BE, and BLK. The EYE signal provides an indication of a state of an eye of a user. A flat region of the EYE signal represents a state in which the eyelid of the user is open, e.g., a period during which the eye of the user is opened. The V-shaped region represents a period in which the eyelid of the user is substantially, completely closed, and/or slightly opened. In one embodiment, the V-shaped region corresponds to a period during which the eye of the user starts to be closed, is completely closed, and then starts to be opened.

The blinking sensor 700 senses the eye state signal EYE to generate the blinking signal BLK. The controller 600 generates the start pulse vertical signal STV based on the blinking signal BLK. For example, the start pulse signal STV is generated to be synchronized with the blinking signal BLK. The controller 600 also synchronizes the data enable signal DE with the blinking signal BLK (or start pulse vertical signal STV). Therefore, each pixel is refreshed based on the data voltage being applied within a time period corresponding to when (e.g., at or near the moment) the user blinks his or her eye.

Because the refresh period is based on the blinking signal, the refresh period will vary (e.g., not be constant) and thus will be different from the period of the start pulse vertical signal STV, which is constant, for example, at 1 Hz. When a user does not blink his or her eye often, the refresh period will generally vary in a period longer than 1 second (1 Hz).

When refresh is performed, fluctuation in the output luminance appears due to asymmetric rising and falling characteristics of pixel charging depending on the polarity of the data voltage. As shown in FIG. 5, fluctuation in the output luminance may cause flicker. However, because has his or her eye(s) at least partially closed during a period when fluctuation in the output luminance appears, the user may not see the fluctuation in output luminance. For example, fluctuation in output luminance may occur during the span of time from when a user begins to close his or her eye(s), has his or her eye(s) completely closed, and then begins to open his or her eyes, as detected by the blinking sensor 700. In one embodiment, the time period starts when the eyelid is detected to be closed by a predetermined fraction, when the eyelid is completely closed, and then when the eye opens to the same or a different predetermined fraction. In FIG. 5, dotted rectangles are used to indicate the time period of recognition luminance that occurs when output luminance fluctuates and thus which is not recognized by the user.

Also, in FIG. 5, BE is a blinking enable signal which controls whether the start pulse vertical signal STV is to be generated based on the blinking signal BLK. The blinking enable signal may be generated, for example, when the presence of a user is detected after a predetermined period of time has elapsed in which the presence of a user is not detected. In one embodiment, the signal controller 600 may generate the start pulse vertical signal STV to be synchronized with the blinking signal BLK only during a high value of the blinking enable signal BE.

The blinking enable signal BE may be particularly suitable when multiple users are present. For example, during low frequency driving, the start pulse vertical signal STV may be generated depending on the blinking of an eye of any one of the users. When this occurs, flicker may be much more recognizable by other users who have not blinked as the refresh period increases. Therefore when multiple users are present, the blinking enable signal BE may be set to a predetermined value, which, for example, may be a low value.

According to one embodiment, the blinking enable signal BE may control whether to generate the blinking signal BLK. When the blinking enable signal has a high value, the start pulse vertical signal STV may be generated to be synchronized with the blinking signal BLK, when the blinking signal BLK is input into the signal controller 600. When the blinking enable signal BE does not have a high value (e.g., a low value), the blinking signal BLK may not be generated and the signal controller 600 may generate the start pulse vertical signal STV to be synchronized with the vertical synchronization signal Vsync. In one embodiment, the blinking enable signal BE may be set to have a high value at a time of low frequency driving. This setting may be changed by the user (e.g., in response to a user-generated signal) or the signal controller.

Figure 6:
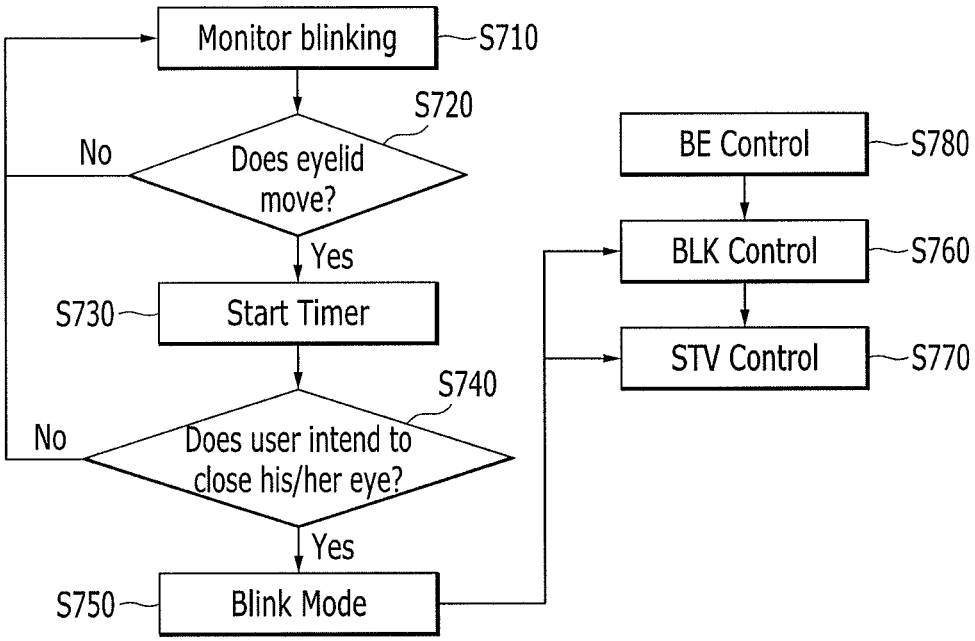
FIG. 6 illustrates an embodiment of a method for low frequency driving.

FIG. 6 illustrates an embodiment of a method for controlling a signal depending on blinking at the time of low frequency driving. Referring to FIG. 6, initially, the blinking sensor 700 monitors blinking of the eye(s) of a user to sense whether at least one eyelid of the user moves (operation S710). For example, when at least one eyelid of the user descends to cover about ½ of the pupil, the blinking sensor 700 may be set to sense motion of the eyelid. When motion of the eyelid is sensed (operation S720), a timer is started (operation S730) and the blinking sensor 700 senses whether the user intends to close an eye after a predetermined time has elapsed (operation S740). For example, when the eyelid descends to cover about ⅔ or more of the pupil, the blinking sensor 700 may be set to sense that the user intends to close his or her eye.

The predetermined time may be set to correspond to a typical eye closing speed. For example, the predetermined time may be set to be about ⅙ the duration of when an eye may be expected to be closed. In other embodiments, the predetermined time may be a different value, taking into consideration, for example, a typical time required for a human to move his or her eye from about ½ of the pupil to about ⅔ of the pupil.

When it is sensed that the user intends to close his or her eye, the liquid crystal display may be driven in a blink mode (operation S750). In this case, the blinking sensor 700 generates the blinking signal BLK (operation S760) and the controller 600 changes the generation period of the start pulse vertical signal STV in response to the blinking signal BLK (operation S770). The blinking enable signal has a high value at this time (operation S780) based, for example, on detection of the presence of at least one user in an area proximate the display device.

Because the shape and size of an eyelid, pupil size and the degree of coverage of the pupil with an eyelid, and eye blinking speed is likely to be different for different people, in one embodiment blinking may be sensed based on information in a database that is personalized for each user, based on, for example, on eyelid position and moving speed.

Figure 7:
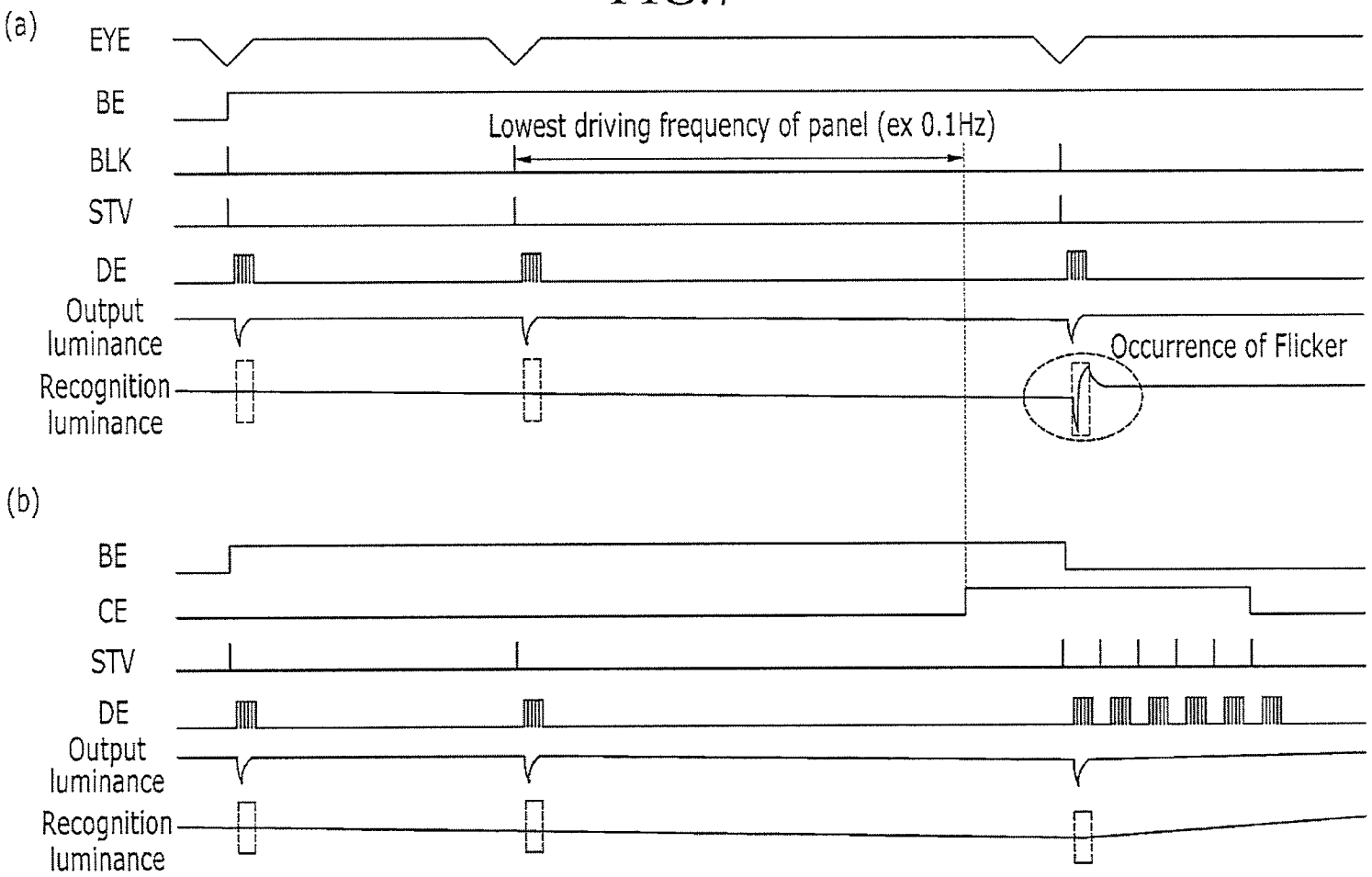
FIG. 7 illustrates an embodiment for performing compensation control.
Figure 8:
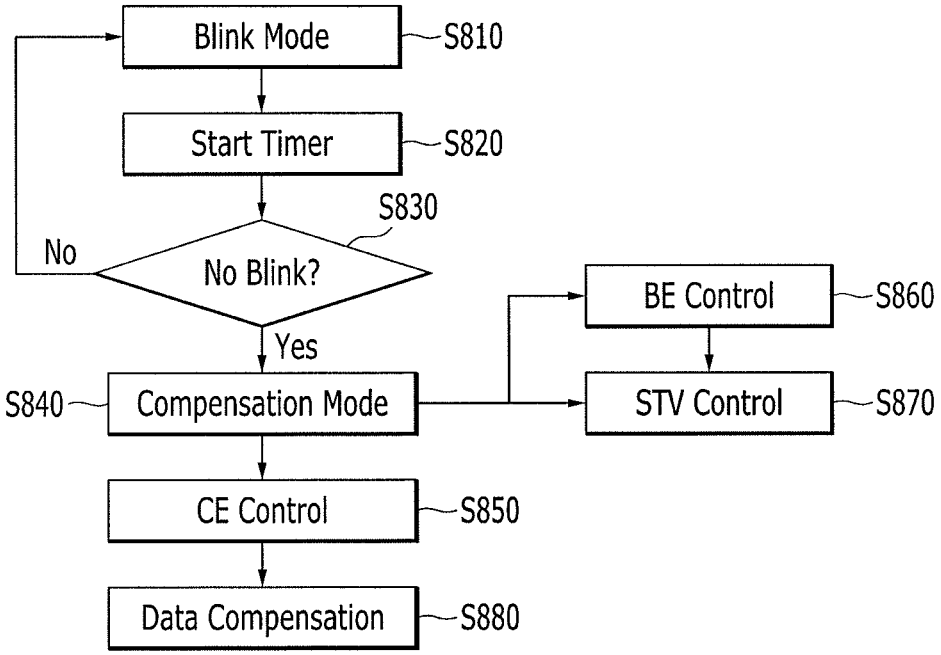
FIG. 8 illustrates an embodiment of a compensation control method.

FIG. 7 illustrates a relationship between a signal and luminance and compensation control depending during low frequency driving according to another embodiment. FIG. 8 illustrates an embodiment of a method for performing compensation control of the signal when a blinking interval is long during low frequency driving. FIG. 9 illustrates an example of a lookup table used to perform compensation control of the signal in FIG. 8.

In the case where blinking occurs at a normal rate, refresh may be performed by generating the start pulse vertical signal STV to be synchronized with the blinking signal BLK, as described in FIGS. 5 and 6. However, in a case where the blinking frequency of the user is less than a predetermined (e.g., lowest) driving frequency of the display panel (e.g., when the blinking period is larger than 1/(lowest driving frequency of display panel)), the recharge period of the pixel may be considered to be long. This is so especially where refresh is performed depending on a start pulse vertical signal STV which is synchronized with the blinking signal BLK. In this circumstance, there may be no small difference in luminance after and before refresh. The predetermined (e.g., lowest) driving frequency of the display panel may be determined, for example, based on a voltage hold ratio of the display panel. Also, a normal blinking rate may correspond to frequencies of blinking greater than the predetermined driving frequency of the display panel.

When the user has his or her eye(s) closed during refresh (that is, during the change in luminance), the user may not see flicker at this time. However, because the difference in luminance immediately before the user closes his or her eye(s) and immediately after the user opens his or her eye is large, the user may recognize the difference in luminance as flicker when the user opens his or her eye(s). This is evident from a third refresh indicated by the dotted oval in the upper timing diagram of FIG. 7(*a*).

When blinking signal BLK is not generated within a period determined by the lowest driving frequency of the display panel (within a predetermined or long period), generation of the start pulse vertical signal STV may be controlled based on a compensation enable signal CE.

Referring to FIG. 7(*b*) and FIG. 8, in accordance with one embodiment operation may begin during blink mode (operation S810) during low frequency driving. At the beginning of blink mode or a predetermined time thereafter, a timer is started (operation S820). At this time a compensation enable signal CE is low. A determination is then made as to whether no blink has occurred during a predetermined time (operation S830). If a blink has occurred, blink mode is maintained and the timer is reset and begins counting again through a repeat of operations S810 and S820.

If a blink has not occurred during the predetermined time, the compensation mode is activated (operation S840) and the compensation enable signal CE is changed from a low value to a high value (operation S850). A predetermined time after the CE signal goes high, the BE signal goes low (operation S860). The start pulse vertical signal STV is generated at constant intervals as long as the CE signal has a high value and in synchronism with the changing of the BE signal to a low value (operation S870).

The CE signal may maintain a high value during low frequency driving until the detected frequency of blinking equals or becomes greater than the predetermined driving frequency of the display panel or when moving images are detected.

During the compensation mode, the signal controller 600 may generate the start pulse vertical signal STV of a normal driving frequency (the still image frequency of, for example, 10 Hz or the moving image frequency of, for example, 60 Hz) at the time the blinking signal BLK is input.

Data compensation may then be performed (operation S880). Taking into consideration reduced luminance that may occur immediately before refresh, the data voltage (which may represent the same or substantially the same luminance as the reduced luminance) may be applied to the pixel. Then, a data voltage having a gradually increasing gray scale value may be applied to the pixel.

In order to apply the data voltage having the gradually increasing gray scale value, a separate lookup table may be used. For example, when a pixel displays a still image using 254 gray scale values and then represents the luminance of 249 gray scale values immediately before refresh (due to gradually reducing luminance) in the compensation mode, the pixel may be driven in such a manner that a data voltage of 249 gray scale values is applied to the corresponding pixel in a first frame, a data voltage of 250 gray scale values is applied to the pixel in a second frame, and the gray scale value is gradually increased and then 254 gray scale values, which is a normal gray scale value, is applied in a fifth frame.

FIG. 9 illustrates an example of a lookup table which may be used to apply stepwise the compensation data voltage as described above. A difference between the normal gray scale value and the gray scale value of the first frame may be compensated depending on a difference between an ending timing of the period determined by the lowest driving frequency of the display panel and the next refresh timing. When the compensation mode ends, the blinking mode may be set to start again.

Meanwhile, the state in which the user continues to close his or her eye(s) may be considered. The blinking sensor 700 may generate an eye closing signal when an eyelid is not opened, even after the eyelid is completely closed and then the predetermined time passes. The controller 600 receives the eye closing signal and controls driving in a manner to reduce power consumption. This driving control may include, for example, generating the start pulse vertical signal STV as in the blinking mode as described above, or generating the start pulse vertical signal STV at the lowest driving frequency period of the display panel. Additionally, or alternatively, driving control may include turning off a light source such as a backlight.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A liquid crystal display, comprising:

a display panel including a plurality of gate lines, a plurality of data lines, and a plurality of pixels;

a gate driver to apply a gate-on voltage to each of the plurality of gate lines;

a data driver to apply a positive data voltage and a negative data voltage to the plurality of data lines;

a signal controller to control the gate driver and data driver and to receive image data; and a sensor to generate a blinking signal for input into the signal controller, wherein the signal controller is to drive the data driver and gate driver at one of a moving image frequency or still image frequency, and wherein the signal controller is to control refresh of the plurality of pixels based on the blinking signal from the sensor when a still image is displayed, and wherein the refresh of the plurality of pixels involves recharging the plurality of pixels by applying data voltages to the plurality of pixels, wherein the sensor is to sense blinking based on motion of an eyelid of a user proximate the display panel.

2. The display as claimed in claim 1, wherein the signal controller is to control refresh of the plurality of pixels by generating a start pulse vertical signal STV synchronized with the blinking signal.

3. The display as claimed in claim 2, wherein the signal controller is to synchronize a data enable signal with the start pulse vertical signal STV, which is synchronized with the blinking signal.

4. The display as claimed in claim 2, wherein the data driver is to supply each of the plurality of pixels with a data voltage, a polarity of the data voltage inverted depending on the start pulse vertical signal STV.

5. The display as claimed in claim 2, wherein the signal controller generates the start pulse vertical signal STV in synchronism with the blinking signal based on a blinking enable signal BE.

6. The display as claimed in claim 2, wherein:

when a period of the blinking signal is longer than a period determined based on the still image frequency of the display panel, the signal controller generates the start pulse vertical signal STV irrespective of receiving the blinking signal.

7. The display as claimed in claim 6, wherein the signal controller is to generate the start pulse vertical signal STV to be synchronized with the still image frequency.

8. The display as claimed in claim 2, wherein:

when a period of the blinking signal is longer than a period determined based on the still image frequency of the display panel, the signal controller is to control of the display panel using a compensation lookup table, and the compensation lookup table includes values to compensate for a declined pixel voltage at a time of receiving the blinking signal.

9. The display as claimed in claim 8, wherein the signal controller is to generate the start pulse vertical signal STV at a substantially constant rate at a time of receiving the blinking signal.

10. A method for driving a liquid crystal display, comprising:

receiving image data;

identifying whether the image data is a moving image or a still image;

controlling a gate driver and a data driver to display a moving image at a moving image frequency when the moving image is identified and to display a still image at a still image frequency when the still image is identified;

sensing blinking to generate a blinking signal; and controlling refresh of one or more pixels in response to the blinking signal when the still image is displayed, wherein the refresh of one or more pixels involves recharging the one or more pixels by applying data voltages to the one or more pixel, wherein the blinking is sensed based on motion of an eyelid of a user proximate the display panel.

11. The method as claimed in claim 10, wherein controlling refresh of the one or more pixels includes generating a start pulse vertical signal STV synchronized with the blinking signal.

12. The method as claimed in claim 11, further comprising:

synchronizing a data enable signal with the start pulse vertical signal STV, which is synchronized with the blinking signal.

13. The method as claimed in claim 11, further comprising:

inverting a polarity of a data voltage to each of the one or more pixels depending on the start pulse vertical signal STV.

14. The method as claimed in claim 11, wherein generating the start pulse vertical signal STV synchronized with the blinking signal is controlled based on a blinking enable signal BE.

15. The method as claimed in claim 11, wherein generating the start pulse vertical signal STV is performed when a period of the blinking signal is longer than a period based on the still image frequency of the display panel and regardless of whether the blinking signal is received.

16. The method as claimed in claim 15, wherein the start pulse vertical signal STV is synchronized with the still image frequency.

17. The method as claimed in claim 11, wherein:

controlling the data driver based on a compensation lookup table when a period of the blinking signal is longer than a period based on the still image frequency, the compensation lookup table including declined pixel voltages at the time of receiving the blinking signal.

18. The method as claimed in claim 17, wherein the start pulse vertical signal STV is generated at a substantially constant interval at a time of receiving the blinking signal.

19. The driving method as claimed in claim 10, wherein the blinking signal is generated only when the still image is displayed.

* * * * *